US006477731B2

(12) United States Patent
Monahan

(10) Patent No.: US 6,477,731 B2
(45) Date of Patent: Nov. 12, 2002

(54) MOP WITH SELF-CONTAINED WRINGER

(76) Inventor: Patrick H. Monahan, 202 N. Oak, Arcola, IL (US) 61910

( * ) Notice: Subject to any disclaimer, the term of this patent is extended or adjusted under 35 U.S.C. 154(b) by 10 days.

(21) Appl. No.: 09/817,813

(22) Filed: Mar. 26, 2001

(65) Prior Publication Data

US 2002/0133892 A1 Sep. 26, 2002

(51) Int. Cl.[7] ..... A97L 13/142
(52) U.S. Cl. ..... 15/120.1
(58) Field of Search ..... 15/119, 120.1, 15/120.2

(56) References Cited

U.S. PATENT DOCUMENTS

| | | | | |
|---|---|---|---|---|
| 135,400 A | | 2/1873 | Boyden | |
| 1,709,622 A | | 4/1929 | Justis | |
| 3,364,512 A | | 1/1968 | Yamashita et al. | 15/260 |
| 3,462,788 A | | 8/1969 | Abbott | |
| 3,501,796 A | | 3/1970 | Moss | 15/118 |
| 3,616,484 A | * | 11/1971 | Charvat | |
| 1,300,709 A | | 12/1972 | Chatwin | |
| 3,946,457 A | | 3/1976 | Robinson | 15/119 |
| 4,114,224 A | * | 9/1978 | Disko | |
| 4,809,387 A | | 3/1989 | Nakamura et al. | 15/119 |
| 2,622,785 A | | 5/1989 | Wertz | 12/24 |
| 5,577,290 A | | 11/1996 | Monahan | 15/120.1 |
| 5,675,858 A | | 10/1997 | Von Meyer | 15/119 |
| 6,108,848 A | | 8/2000 | Monahan | 15/119.1 |

FOREIGN PATENT DOCUMENTS

| | | | |
|---|---|---|---|
| DE | 3607121 | * | 9/1987 |
| EP | 1180341 | * | 3/2001 |
| FR | 2622785 | | 5/1989 |
| GB | 1300709 | | 12/1972 |

* cited by examiner

*Primary Examiner*—Terrence R. Till
(74) *Attorney, Agent, or Firm*—R. William Graham

(57) ABSTRACT

A mop having a self-contained wringer includes a handle, a sleeve frictionally movably disposed on the handle such that the sleeve is self supporting along a number of positions of the mop handle, a retainer member connected to an end of the handle and having a retaining surface, a mop head material having one end connected to the retaining surface of the retainer member, a twistable rubber-like generally fluted housing portion having a first end connected to the sleeve and a second end extending outwardly therefrom creating a mop head receiving surface area between a portion of the handle and an inner surface of the housing. The housing is movable along the handle by way of the sleeve in a manner to removably enclose the mop head material and enable squeezing of the mop head material by virtue of its rubber-like characteristic wherein it can twist over itself to selectively reduce the receiving surface area.

7 Claims, 3 Drawing Sheets

MOP WITH SELF-CONTAINED WRINGER

BACKGROUND OF THE INVENTION

1. Field of the Invention

The present invention relates to mops. More particularly, the invention relates to a wet mop having a self-contained wringer and unique wringing element which is incorporated on the mop or may be retrofit to a conventional wet mop.

2. Related Art

There exist numerous types of mops in the art, such as twist mops, squeeze mops, wringer mops, etc. Each of these mops will include a handle, mop head material connected to the handle and means for removing water from the mop head material upon demand.

A problem associated with prior mop designs is the way in which to they wring the absorbed liquid from the mop head material connected to the mop handle. In the case of self wringing type mops, there lacks a sufficient means for wringing the mop head material in a manner to permit effective removal of the absorbed liquid while minimizing damage to the mop head material.

Most mechanical wringers fail to adequately provide a way to control the amount of water remains in the mop head. This is because these mechanical wringers are designed to make a single pass across the mop head wringing from the top down and restricting the mop head material into a predetermined amount of space. This is not found to be desirable since it reduces the life of the mop head material and does not provide for any selectivity in the amount of water to be drained from the material. There is a desire to provide a mop wringer which can control the amount of water is squeezed from the mop head and do so in a less deleterious manner.

Another problem with existing mops is that they do not adequately displace the wringer from the mop head to maximize the use of the mop head material. For example, the mop head material of the self wringing mop is connected to a head having a wringer plate hinged thereto. The wringer plate is pivoted in a manner to squeeze the mop head material. This type of wringer is less desirable as it prevents circumferential access to the mop head material.

Other wringing mechanisms, attached and detached from the mop, twist the mop head material in order to remove the liquid therefrom. This is less desirable as it tends to weaken and wear the material.

Other problems associated with conventional mops is that they have a relatively small footprint for mopping, use only a portion of the yarn/mop head material and is easily tangled. These mops and their current wringing mechanisms are relatively expensive to produce.

There remains a need therefore to provide an improved mop, particularly, a mop having a self-contained wringer with improved wringability and positionability of the mop head material. There is also a need to provide a self-contained wringer which retrofitable to a conventional wet mop, such as a deck mop.

SUMMARY OF THE INVENTION

It is an object of the present invention to improve mops.

It is another object of the present invention to improve self-contained wringing mops.

It is a further object to improve the wringability of a mop with a self-contained wringer.

It is an object to improve the control amount of water in which mop head material can be removed through a wringer.

It is another object to provide a rubber-glove like wringer to substantially avoid water contact with one's hands.

Accordingly, the present invention is directed to a mop having a self-contained wringer which includes a handle, a sleeve frictionally movably disposed on the handle such that the sleeve is self supporting along a number of positions of the mop handle, a retainer member connected to an end of the handle and having, a retaining surface, a mop head material having one end connected to the retaining surface of the retainer member, a twistable rubber-like generally fluted housing portion having a first end connected to the sleeve and a second end extending outwardly therefrom creating a mop head receiving surface area between a portion of the handle and an inner surface of the housing. The housing is movable along the handle by way of the sleeve in a manner to removably enclose the mop head material and enable squeezing of the mop head material by virtue of its rubber-like characteristic wherein it can twist over itself to selectively reduce the receiving surface area.

Another aspect of the present invention is directed to a retrofit self-contained wringer for connection to a mop having a handle and mop head connected thereto. The retrofit self-contained wringer includes a sleeve frictionally movably disposed on the handle such that the sleeve is self supporting along a number of positions of the mop handle and a twistable rubber-like generally fluted housing portion having a first end connected to the sleeve and a second end extending outwardly therefrom creating a mop head receiving surface area between a portion of the handle and an inner surface of the housing. The housing is movable along the handle via the sleeve in a manner to removably enclose the mop head material and enable squeezing of the mop head material through its rubber-like characteristic wherein it can twist over itself to selectively reduce space between the handle and the receiving surface area.

Other objects and advantages will be readily apparent to those skilled in the art upon viewing the drawings and reading the detailed description hereafter.

DETAILED DESCRIPTION OF THE PREFERRED EMBODIMENT

Figure 1:
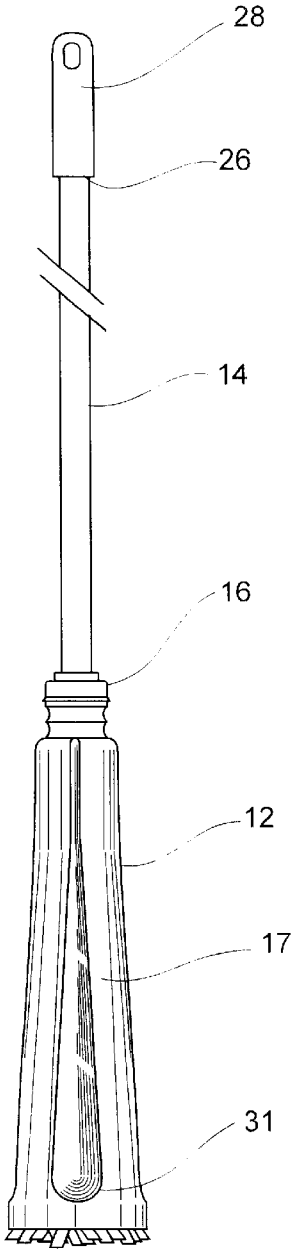
FIG. 1 is an elongated side view of the mop having a self-contained wringer of the present invention.
Figure 2:
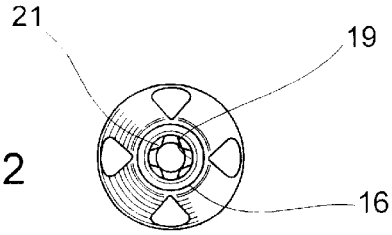
FIG. 2 is top view of the present invention.
Figure 3:
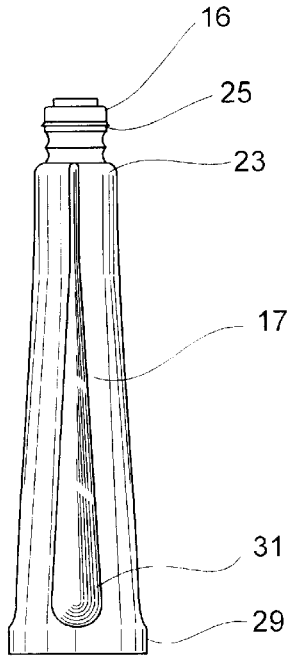
FIG. 3. is a side view of the housing of the present invention.
Figure 4:
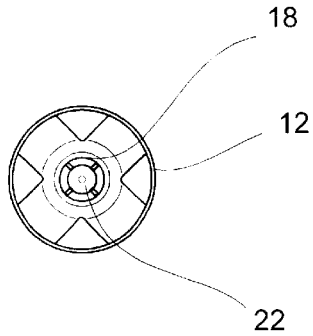
FIG. 4. is bottom view of the present invention.
Figure 5:
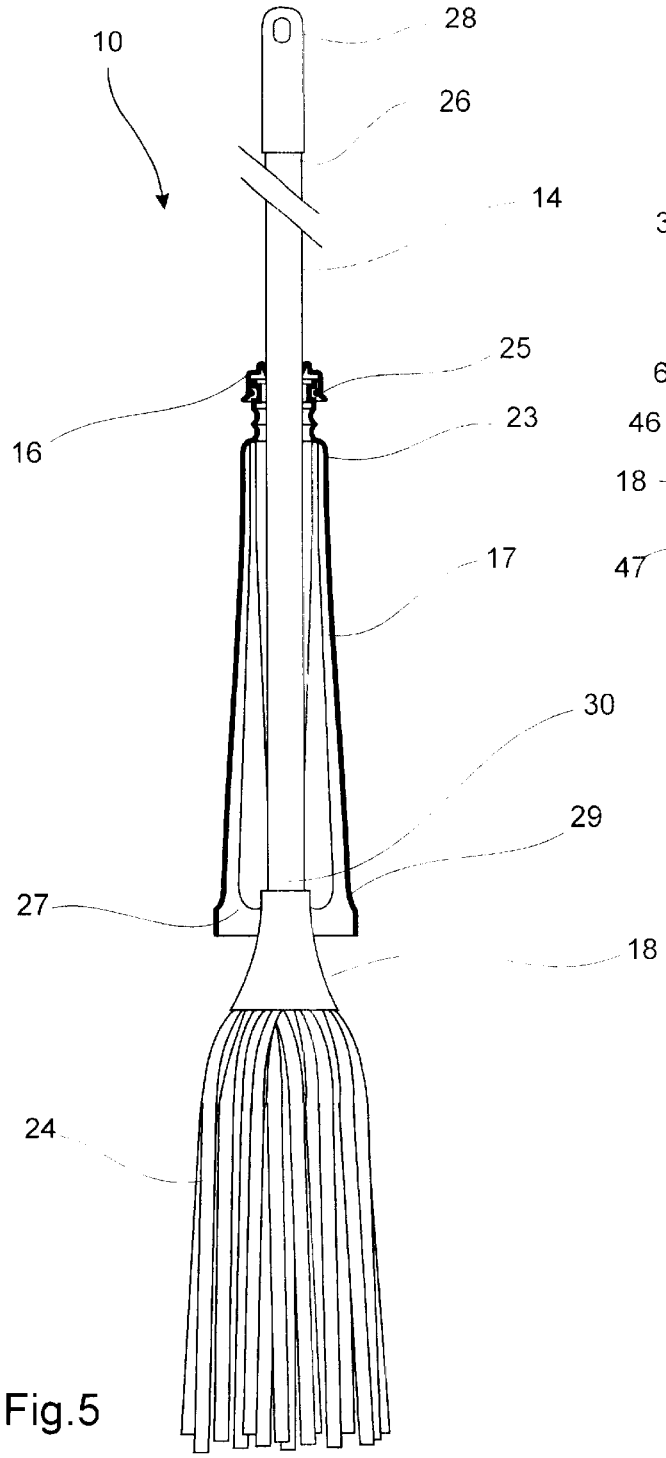
FIG. 5 depicts a cross sectional view of a part of the invention.
Figure 6:
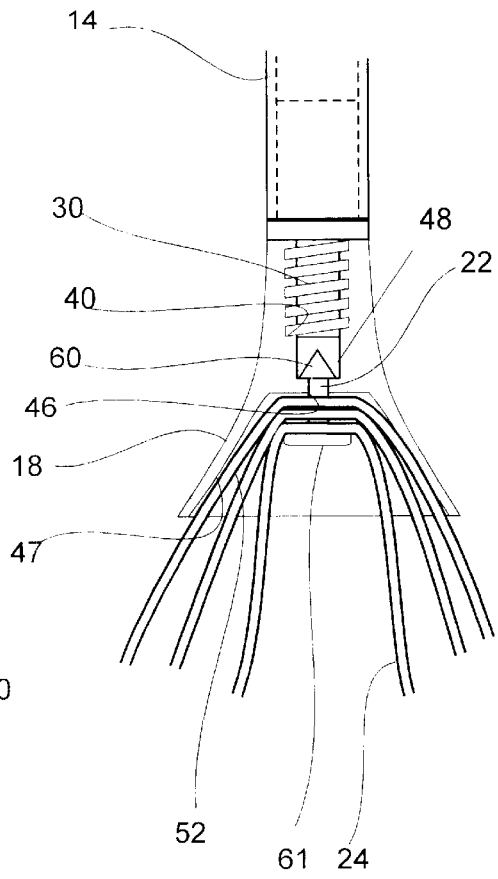
FIG. 6 depicts a cross sectional view of another part of the invention.

Referring now to the drawings, the present invention relates the mop 10 having a self-contained wringer 12. While the mop 10 and self-contained wringer 12 are shown together, it is intended as part of the present invention that the self-contained wringer 12 be part of the mop 10 at a point of purchase or as a separate item which may be retrofit to the mop 10. Accordingly, both embodiments are in the subject matter in the claims appended hereto.

The mop 10 includes an elongated handle 14, the self-contained wringer 12 (formed by a sleeve 16 and a housing 17), retainer member 18 and an insert 22. The retainer member 18 and insert 22 are provided to hold mop head material 24 on the handle 14 within the housing 17. Optionally, a resilient scrub pad material as shown in commonly owned U.S. Pat. No. 6,108,848 which is incorporated herein by reference can be used herewith.

The handle 14 includes an end 26 which may also have an eyelet cap 28 connected thereto to permit the mop 10 to be hung when not in use. The handle 14 has another end 30 formed with a threaded surface for connection to retainer 18.

Figure 7:
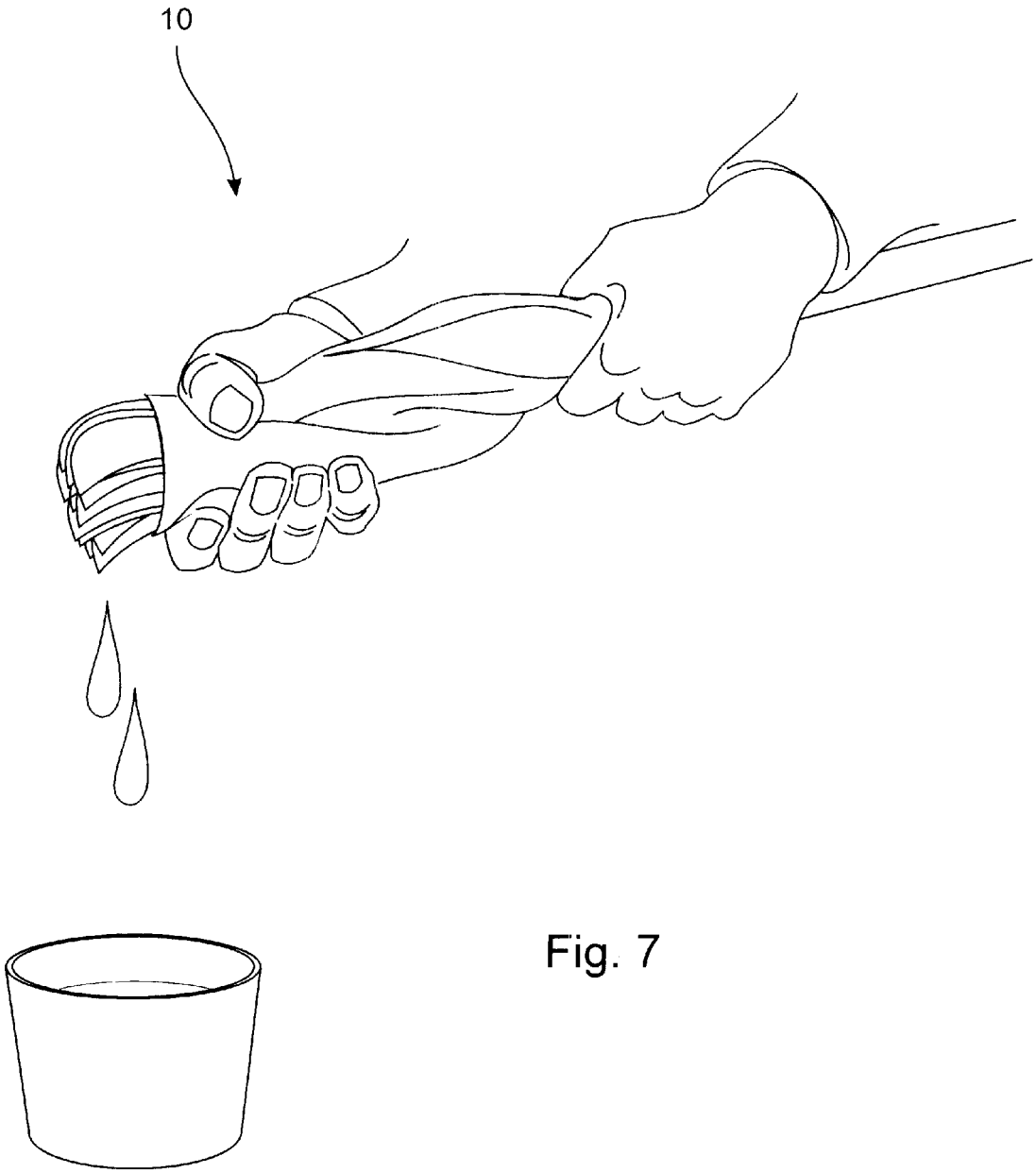
FIG. 7 is another side view of the mop having a self-container wringer in a retracted position.

The sleeve 16 has an inside portion 19 which has a plurality of frictionally engaging fingers 21 which bias against the handle 14 as seen in FIG. 7 in a manner which sufficiently hold the sleeve 16 and associated housing 17 in place while permitting the same to be slid to a desired position along the handle 14.

The housing 17 is further characterized to be generally fluted and has an end 23 connected to an end 25 of the sleeve 16. The sleeve 16 can be made of a plastic material, such as a thermoplastic polymer. A space between the handle 14 and housing 17 forms a receiving surface area 27. The housing 17 can be made of a rubber-like material, such as latex, with the particular characteristic that the housing 17 enable squeezing of the mop head material through its rubberlike characteristic wherein it can twist over itself to selectively reduce the receiving surface area 27. A further characteristic of the housing 17 attributable to its rubber-like material is its ability to act as a rubber love keep water from the user's hands. The thickness of the housing 17 is such to provide sufficient durability as well as ease of twistability.

The diameter of the end 23 is about half that of the end 29 in order to accommodate receiving the mop head material 24, but may take on other shapes to carry out the invention herein. The housing 17 has a series of recessed surface portions 31 longitudinally extending along the exterior of the housing 17. The surface portions 31 as shown here are concave with the curved surface radially inward which aids one in gripping the outside surface of the housing 17 for twisting purposes while its inner surface so configured is less likely to ,rip and twist the mop head material 24 during the twisting of the housing 17.

The retainer member 18 has an end 40 which is formed with an inner threaded surface threaded in a complementary manner to receive threaded end 30 of the handle 14. Another end 46 is includes an inner retention surface 48 to receive a snap-fit male head 60 the insert 22.

The mop head material 24 includes a series of strips of absorbent and durable material as is known in the art, such as woven or unwoven natural or cotton yarn or synthetic materials. For example, the materials may be made of plastic, such as polyester, polyurethane or polyether, or of natural, such as cotton, for example. As shown in the present invention, but not to be limiting, the mop head material 24 is formed with a series of generally parallel cuts to create individual intermediate strips which are joined at an open center surface of each strip, wherein the head 60 of the insert 22 goes through the center surface and is connected to the surface 48. The insert 22 has a retention head 61 which is configured to binds and locks the ends 52 of the mop head material 24 against mop receiving surface 47.

By so providing the structure of the mop described herein, the present invention results in a new and improved mop having a self-contained wringer. A novel aspect of the invention is to provide the selectivity of degree of water removal in a manner which controls water flow out the end 29 of the housing 17. The design shown is less likely cause water to be spilled onto the user. The mop has the improved ability to fully use the mop head material with the wringing device being relatively lightweight and which is readily retractable from the mop head material in a manner which allows peripheral access to the mop head.

The mop is relatively simplistic and inexpensive to manufacture. The self-contained wringer is retrofit ready for use with substantially any conventional wet-deck type mop. The wringer now provides multipurpose of squeezability, controllability, wringability with minimal damage to the mop head material. In addition, the second sleeve provides a squeezing aid which is used to reduce the housing's mop head receiving surface as it is moved over the housing toward the second end of the housing.

The above described embodiment is set forth by way of example and are not for the purpose of limiting the present invention. It will be readily apparent to those skilled in the art that obvious modifications and variations can be made to the embodiment without departing from the scope of the invention. Accordingly, the claims appended hereto should be read in their full scope including any such modifications and variations.

What is claimed is:

1. A mop having a self-contained wringer, which includes:

a handle having a first end and a second end;

a sleeve frictionally movably disposed on said handle such that said sleeve is self-supporting along a number of positions of said mop handle;

a retainer member connected to said first end of said handle and having a retaining surface;

a mop head material having a first end connected to said retaining surface of said retainer member; and a generally fluted rubber-like housing having a first end connected to said sleeve and a second end extending outwardly therefrom creating a mop head material receiving surface area between said second end of said handle and an inner surface of said housing, wherein said housing is movable along said handle via said first sleeve in a manner to removably enclose said mop head material and enable selective squeezing of the mop head material through its rubber-like characteristic wherein said housing can twist over itself to selectively reduce said receiving surface area and wherein said housing includes a series of recessed surface portions longitudinally extending therealong which are concave with the curved surface radially inward to aid one in gripping an outside surface of said housing for twisting purposes while an inner surface of said surface portion is configured to minimize gripping and twisting said mop head material when said twisting of said housing.

2. The mop of claim 1, wherein said sleeve is formed with an inner biasing member which imparts an ability of said sleeve to be readily moved upon a user overcoming a frictional force of said biasing.

3. The mop of claim 1, wherein said housing is latex.

4. The mop of claim 1, wherein said handle is threadably connected to said retainer and said retainer includes a snap-fit insert to aid in retaining said mop head material.

5. A retrofit self-contained wringer for connection to a conventional deck-type wet mop having a handle and mop head connected thereto, which includes:

a first sleeve fictionally movably disposed on the handle such that said first sleeve is self supporting along a number of positions of the handle; and a housing generally fluted rubber-like having a first end connected to said sleeve and a second end extending outwardly therefrom such that when connected to the handle creates a mop head receiving surface area between said second end of said handle and an inner surface of said housing, wherein said housing is movable along said handle via said sleeve in a manner to removably enclose the mop head and enable selective squeezing of the mop head material through its rubber-like characteristic wherein said housing can twist over itself to selectively reduce said receiving surface area and wherein said housing includes a series of recessed surface portions longitudinally extending therealong which are concave with the curved surface radially inward to aid one in gripping an outside surface of said housing for twisting purposes while an inner surface of said surface portion is configured to minimize gripping and twisting said mop head material when said twisting of said housing.

6. The retrofit self-contained wringer of claim 5, wherein said sleeve is formed with an inner biasing member which imparts an ability of said sleeve to be readily moved upon a user overcoming a frictional force of said biasing.

7. The retrofit self-contained wringer of claim 5, wherein said housing is latex.

* * * * *